US009959858B2

(12) United States Patent
Otsuka et al.

(10) Patent No.: US 9,959,858 B2
(45) Date of Patent: May 1, 2018

(54) NOISE-CANCELLING HEADPHONE

(71) Applicants: Koji Otsuka, Tokyo (JP); Yumi Shimazaki, Tokyo (JP); Kozo Ando, Kanagawa (JP)

(72) Inventors: Koji Otsuka, Tokyo (JP); Yumi Shimazaki, Tokyo (JP); Kozo Ando, Kanagawa (JP)

(73) Assignee: KABUSHIKI KAISHA AUDIO TECHNICA, Tokyo (JP)

( * ) Notice: Subject to any disclaimer, the term of this patent is extended or adjusted under 35 U.S.C. 154(b) by 0 days. days.

(21) Appl. No.: 15/228,313

(22) Filed: Aug. 4, 2016

(65) Prior Publication Data

US 2017/0040013 A1 Feb. 9, 2017

(30) Foreign Application Priority Data

Aug. 7, 2015 (JP) ..... 2015-156533

(51) Int. Cl.
*G10K 11/175* (2006.01)
*G10K 11/16* (2006.01)
(Continued)

(52) U.S. Cl.
CPC ..... *G10K 11/175* (2013.01); *G10K 11/16* (2013.01); *G10K 11/178* (2013.01); *H04R 1/1083* (2013.01); *G10K 2210/1081* (2013.01); *G10K 2210/509* (2013.01); *H04R 1/086* (2013.01); *H04R 2460/01* (2013.01)

(58) Field of Classification Search
CPC ..... G10K 11/175; G10K 11/178; G10K 2210/1081; G10K 11/16; G10K 2210/509; H04R 1/1083; H04R 1/086; H04R 2460/01; H04R 1/008
See application file for complete search history.

(56) References Cited

U.S. PATENT DOCUMENTS 6,735,316 B1 5/2004 Wurtz
8,472,636 B2 6/2013 Sibbald
(Continued)

FOREIGN PATENT DOCUMENTS

GB 2505919 A 3/2014
JP 2010-109799 A 5/2010
JP 2011087048 A * 4/2011

*Primary Examiner* — Sonia Gay
(74) *Attorney, Agent, or Firm* — Whitham, Curtis & Cook

(57) ABSTRACT

A noise-cancelling headphone is provided that avoids an influence of the wind and prevents degradation in the sound quality of the reproduced sound output from a driver unit. The noise-cancelling headphone includes an ear piece including a housing unit having an interior and an exterior, a driver unit attached to the housing unit, and a microphone collecting external sounds at the exterior of the housing unit. The housing unit includes an accommodating portion accommodating the microphone and a sound collecting hole establishing the communication between the accommodating portion and the exterior of the housing unit. The accommodating portion is disposed in an upper portion of the housing unit of the noise-cancelling headphone when worn by the user. The sound collecting hole is open toward the upper side of the housing unit of the noise-cancelling headphone when worn by the user.

14 Claims, 12 Drawing Sheets

(51) Int. Cl.

| | |
|---|---|
| ***G10K 11/178*** | (2006.01) |
| ***H04R 1/08*** | (2006.01) |
| ***H04R 1/10*** | (2006.01) |

(56) References Cited

U.S. PATENT DOCUMENTS

| | | | | |
|---|---|---|---|---|
| 2009/0010474 | A1* | 1/2009 | Ouryouji | H04R 1/1058 381/370 |
| 2009/0285408 | A1 | 11/2009 | Kimura | |
| 2010/0080400 | A1 | 4/2010 | Sibbald et al. | |
| 2011/0044464 | A1 | 2/2011 | Sapiejewski et al. | |
| 2011/0044465 | A1* | 2/2011 | D'Agostino | G10K 11/178 381/71.6 |
| 2012/0015532 | A1* | 1/2012 | Markovich | H05K 3/3436 439/78 |
| 2012/0128191 | A1* | 5/2012 | Jung | H04R 1/2892 381/361 |
| 2014/0105413 | A1* | 4/2014 | Clemow | G10K 11/178 381/71.8 |
| 2014/0169579 | A1 | 6/2014 | Azmi | |

* cited by examiner

NOISE-CANCELLING HEADPHONE

TECHNICAL FIELD

The present invention relates to noise-cancelling headphones, in particular, to feedforward noise-cancelling headphones.

BACKGROUND ART

A headphone having a noise-cancelling function (noise-cancelling headphone) includes a microphone and a noise-cancelling circuit (hereinafter referred to as "NC circuit"). The microphone collects external sounds (hereinafter referred to as "noises") around the headphone. The NC circuit generates cancelling signals corresponding to the noises collected by the microphone. The headphone combines sound waves corresponding to the cancelling signals generated by the NC circuit and sound waves corresponding to the reproduced signals from a sound source such as a music player connected to the headphone, and then outputs the combined sound waves from a driver unit. That is, the headphone outputs musical sounds (hereinafter referred to as "reproduced sounds") derived from the reproduced signals from the sound source with cancelling (muting) of the noises.

Examples of the scheme for generating cancelling signals include a feedback scheme (hereinafter referred to as FB) and a feedforward scheme (hereinafter referred to as FF).

A built-in microphone of the FB noise-cancelling headphone is disposed in the interior of a housing unit (ear piece) of the headphone and near the ear of the user. The NC circuit analyses in real-time the signals of the noises collected by the microphone and generates cancelling signals minimizing the noises at the position of the eardrum of the user. The FB noise-cancelling headphone collects the noises at the position near the ear of the user. Thus, the noise-cancelling effect of the FB noise-cancelling headphone is higher than that of the FF noise-cancelling headphone. In addition, the response of the FB noise-cancelling headphone to the variation of noise components is good.

However, when the built-in microphone of the FB noise-cancelling headphone collects the reproduced sounds in addition to the noises, and then the NC circuit generates cancelling signals, the sound quality of the reproduced sounds output from the headphone are degraded. In addition, the ear piece of the FB noise-cancelling headphone should be sealed in the state which the headphone is worn on the head of the user, to enhance the noise-cancelling effect. When the ear piece is sealed, the reproduced sounds output from the headphone may be muffled. Thus, the sound quality of the reproduced sounds are degraded. To address the problem, a FB noise-cancelling headphone generally includes a filter to correct the sound quality of the reproduced sounds.

On the other hand, a built-in microphone of the FF noise-cancelling headphone is disposed at the exterior of the housing unit of the headphone. The NC circuit analyses the signals of the noises collected by the microphone and predicts the variation in the noises that will reach the eardrum of the user wearing the headphone. The NC circuit generates cancelling signals based on the result of the prediction. The FF noise-cancelling headphone does not need the placement of the microphone on a limited space near the ear of the user. In addition, the built-in microphone of the FF noise-cancelling headphone is disposed at a position remote from the driver unit. Thus, the FF noise-cancelling headphone is less likely to collect the reproduced sound output from the driver unit and to generate cancelling signals from the reproduced sounds than the FB noise-cancelling headphone. That is, the sound quality of the reproduced sound output from the FF noise-cancelling headphone are less susceptible to the cancelling signals generated from the reproduced sounds than the sound quality of the reproduced sound output from the FB noise-cancelling headphone.

Unfortunately, the FF noise-cancelling headphone often indicates directionality of the noise-cancelling effect depending on the position of the built-in microphone. Unlike the built-in microphone of the FB noise-cancelling headphone, the built-in microphone of the FF noise-cancelling headphone is disposed at the exterior of the housing unit. Thus, the FF noise-cancelling headphone generates noises caused by wind pressure of the blowing of the wind, for example. In other words, the FF noise-cancelling headphone is susceptible to the influence of the wind around the headphone. As a result, the FF noise-cancelling headphone can cause a feeling of strangeness or discomfort to the user, when the noise-cancelling function is activated.

Schemes have been proposed to dispose a microphone in the interior of the housing unit of the FF noise-cancelling headphone to avoid the influence of the wind described above (for example, refer to Japanese Unexamined Patent Application No. 2010-109799).

The FF noise-cancelling headphone disclosed in Japanese Unexamined Patent Application No. 2010-109799 includes a driver unit, a baffle plate, and a microphone. The microphone is disposed behind the baffle plate to which the driver unit is attached (that is, in the interior of a rear air chamber). The baffle plate includes a flange portion and a groove. The flange portion is disposed on the forward portion and the rear portion in the thickness direction of the baffle plate. The groove is formed between the flange portion and along the outer circumference of the baffle plate. The flange portion that is disposed on the rear portion of the baffle plate has a sound collecting hole penetrating the flange portion in thickness direction. The sound collecting hole is in communication with the groove. The external noises are collected by the microphone through the groove and the sound collecting hole.

SUMMARY OF INVENTION

Technical Problem

For the FF noise-cancelling headphone disclosed in Japanese Unexamined Patent Application No. 2010-109799, the noise reaching the headphone changes direction in the interior of the groove and is then collected by the microphone. Thus, the prediction of the variation in the noise described above requires highly sophisticated calculation. This requirement may hinder the FF noise-cancelling headphone disclosed in Japanese Unexamined Patent Application No. 2010-109799 from exhibiting sufficient noise-cancelling effect. In addition, the microphone of the FF noise-cancelling headphone disclosed in Japanese Unexamined Patent Application No. 2010-109799 is disposed in the interior of the rear air chamber. The microphone may collect reproduced sounds output from the driver unit. When the microphone collects the reproduced sounds, the NC circuit generates cancelling signals corresponding to the reproduced sounds in addition to the cancelling signals corresponding to the external noises. As a result, the sound quality of the reproduced sound output from the driver unit may be degraded by the influence of the cancelling signals corresponding to the reproduced sounds in addition to the cancelling signals corresponding to the external noises.

As described above, noise-cancelling headphones, in particular, FF noise-cancelling headphones are required to avoid the influence of the wind and to prevent the degradation in the sound quality of the reproduced sound output from the driver unit.

An object of the present invention is to solve the problems described above, and to provide a noise-cancelling headphone that can avoid the influence of the wind and prevent the degradation in the sound quality of the reproduced sound output from the driver unit.

Solution to Problem

An exemplary noise-cancelling headphone according to the present invention includes an ear piece including a housing unit having an interior and an exterior, a driver unit attached to the housing unit, and a microphone collecting external sounds at the exterior of the housing unit. The housing unit includes an accommodating portion accommodating the microphone and a sound collecting hole establishing the communication between the accommodating portion and the exterior of the housing unit. The accommodating portion is disposed in an upper portion of the housing unit of the noise-cancelling headphone when worn by the user. The sound collecting hole is open toward the upper side of the housing unit of the noise-cancelling headphone when worn by the user.

The noise-cancelling headphone according to the present invention can avoid the influence of the wind and prevent degradation in the sound quality of the reproduced sound output from the driver unit.

DESCRIPTION OF EMBODIMENTS

Embodiments of a noise cancelling headphone (hereinafter referred to as "headphone") will now be described with reference to the attached drawings. The headphone includes a left ear piece (a first ear piece), a right ear piece (a second ear piece) and a connection member. The right and left ear pieces are connected with each other by the connection member. The structure of the right ear piece is the same as the structure of the left ear piece. Thus, the structure of the left ear piece is described as an example below.

Figure 1:
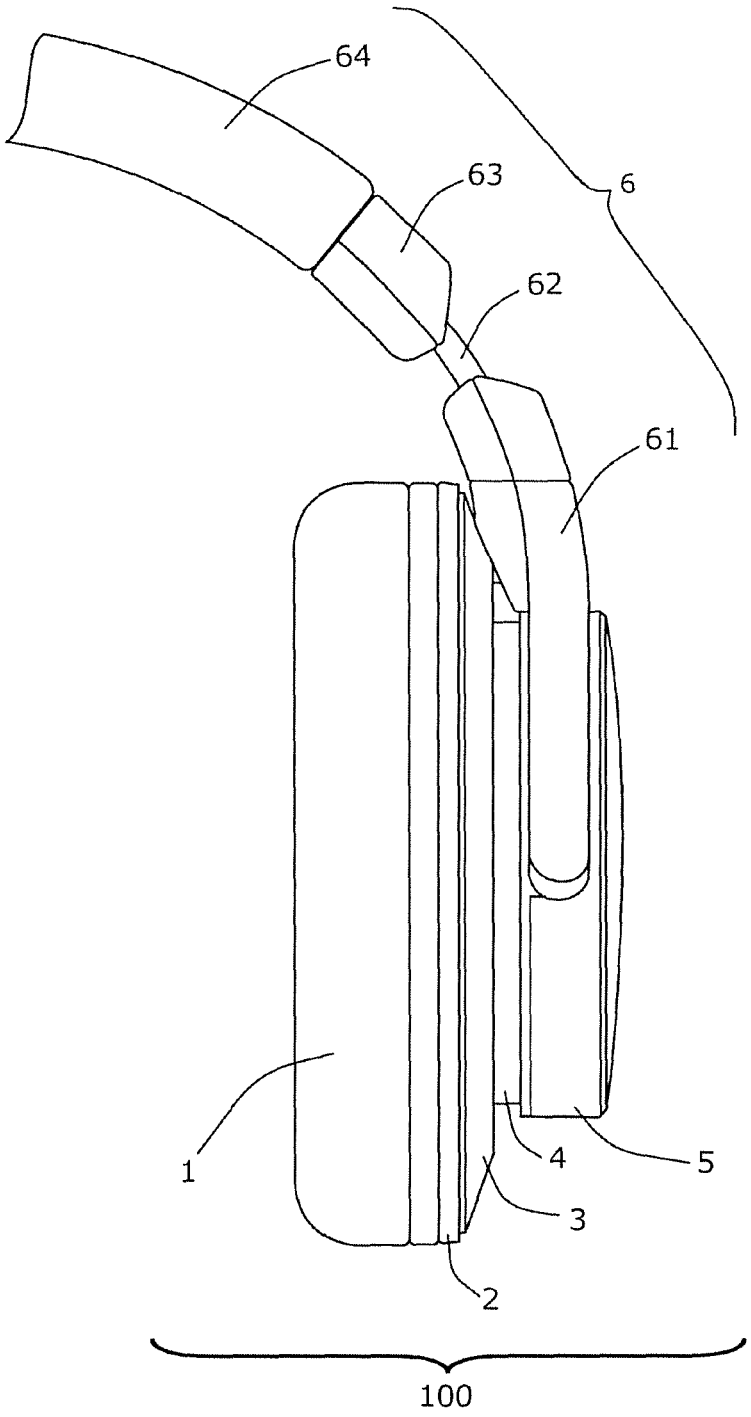
FIG. 1 is a front view of a left ear piece of the noise-cancelling headphone according to an embodiment of the present invention.

FIG. 1 is a front view of the left ear piece of the head phone according to an embodiment of the present invention.

Figure 2:
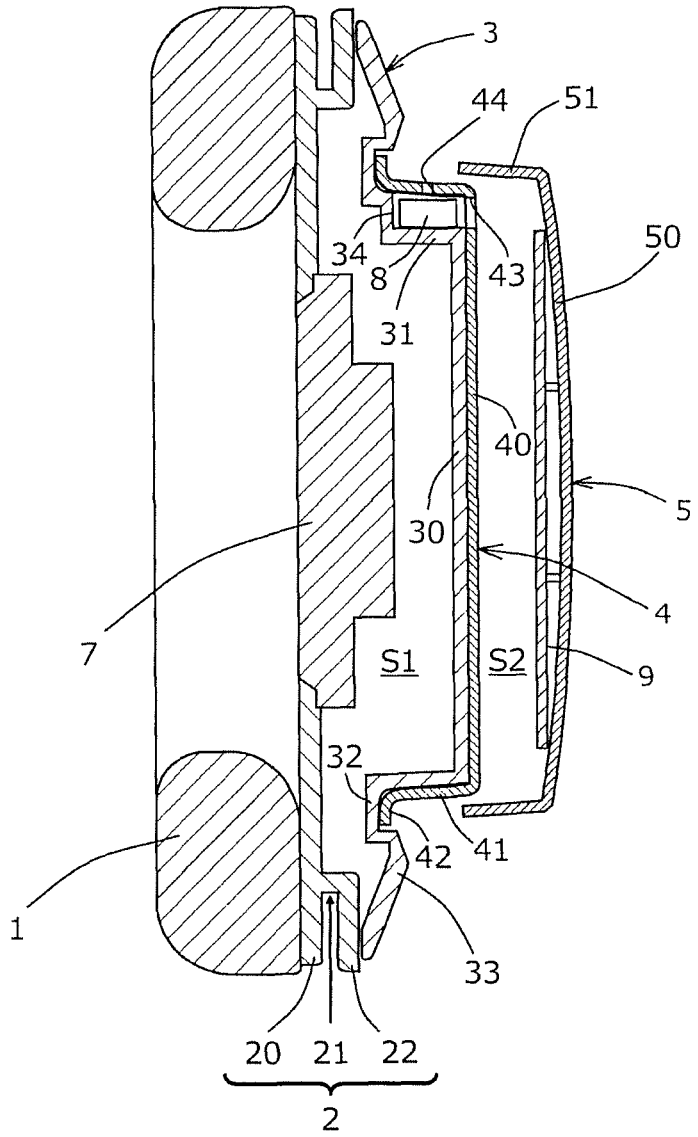
FIG. 2 is a cross-sectional front view of the ear piece of FIG. 1.

FIG. 2 is a cross-sectional front view of the left ear piece.

The ear piece 100 includes an ear pad 1, a baffle plate 2, a first housing 3, a housing cover 4, a second housing 5, a driver unit 7, a microphone 8, and a circuit board 9. In the description below, all or any of the baffle plate 2, the first housing 3, the housing cover 4, and the second housing 5 are referred to as "housing unit". That is, the housing unit constitutes the ear piece 100. The housing unit has an interior and an exterior.

The ear pad 1 is a buffer disposed between the ear piece 100 and the head of the user. The ear pad 1 has an annular shape, and surrounds the ear of the user when the headphone is worn on the head of the user. The ear pad 1 is composed of a covering member and a resilient member. The ear pad 1 has a resilience by having the resilient member packed inside the covering member. The covering member is composed of a material having a smooth and soft texture, such as leather and chemical fibers. The resilient member is composed of a material having resilience, such as urethane foam, cotton, and chemical fibers.

The baffle plate 2 supports the driver unit 7, separating the forward and the rear of the driver unit 7 acoustically. The driver unit 7 converts audio signals from the sound source into sound waves and then outputs the sound waves.

In the description below, "forward" refers to a direction toward which the driver unit 7 outputs sound waves (the left side in FIG. 2). "Rear" and "behind" refer to the opposite direction.

The first housing 3 forms an air chamber S1 behind the driver unit 7. The first housing 3 is disposed behind the baffle plate 2.

The housing cover 4 forms an accommodating portion accommodating the microphone 8. The housing cover 4 is disposed behind the first housing 3. The accommodating portion will be described below.

The second housing 5 accommodates the circuit board 9. The circuit board 9 will be described below. The second housing 5 is disposed behind the housing cover 4, that is, behind the first housing 3. The second housing 5 has bearing holes (not shown). The bearing holes are disposed in a front (the front side in FIG. 1) surface of the second housing 5 and a back (the back side of FIG. 1) surface of the second housing 5.

The connection member 6 is configured for fixing the ear piece 100 (the left ear piece) and the right ear piece to the head of the user. The ear piece 100 is connected to the right ear piece by a connection member 6. The connection member 6 includes an arm member 61, a slider 62, a fixing member 63, and a headband 64.

The arm member 61 connects the ear piece 100 with the slider 62. The arm member 61 has a bifurcated arm and connecting pins. The connecting pins correspond to the bearing holes of the second housing 5. The connecting pins are coaxially aligned at the top ends of the bifurcated arm.

The connecting pins are received in the respective bearing holes of the second housing 5. The ear piece 100 is supported swingably in the predetermined angular range around the axis between the connecting pins by the arm member 61.

The slider 62 has an adjusting structure to adjust the position of the ear piece 100 corresponding to the headband 64. One end of the slider 62 is fixed to the arm member 61. The other end of the slider 62 is inserted through openings of the fixing member 63 described below into the internal space of the headband 64. The other end of the slider 62 is supported movably along the longitudinal direction of the headband 64 by the fixing member 63 and the headband 64. That is, the slider 62 allows the ear piece 100 to slide in the longitudinal direction of the headband 64.

The fixing member 63 fixes the slider 62 and the headband 64. The fixing member 63 has openings and a structure for preventing detachment of the slider 62. The openings are disposed at the longitudinal ends of the fixing member 63. The detachment prevention structure prevents the slider 62 from detaching from the headband 64. The slider 62 is longitudinally movable in the internal space of the headband 64. The slider 62 is prevented by the structure for preventing detachment of the slider 62 from detaching from the headband 64, even when the slider 62 moves to the limit in the movable range.

The headband 64 is connected to the right and left ear piece by the arm member 61, the sliders 62, and the fixing member 63. The headband 64 has a curved shape conforming to the top or the back side of the head of the user.

The headband 64 includes a resilient member. The resilient member has a shape of a plate spring. The resilient member is disposed inside the headband 64. That is, the headband 64 has spring properties. The distance between the right and left ear pieces of the headband 64 when the headphone is worn on the head of the user (hereinafter referred to as "in the worn state of the headphone") is different from that of when the headphone is removed from the head of the user (hereinafter referred to as "in the unworn state of the headphone"). That is, the distance between the ear pieces in the worn state of the headphone is longer than the distance between the ear pieces in the unworn state of the headphone. The resilient force of the headband 64 having spring properties is exerted on the ear pieces in the worn state of the headphone. That is, the ear pieces in the worn state of the headphone are biased toward each other by the resilient force of the headband 64. In other words, the ear pieces in the worn state of the headphone are pressed toward and fixed on the right and left ears of the user by the resilient force of the headband 64.

Figure 3:
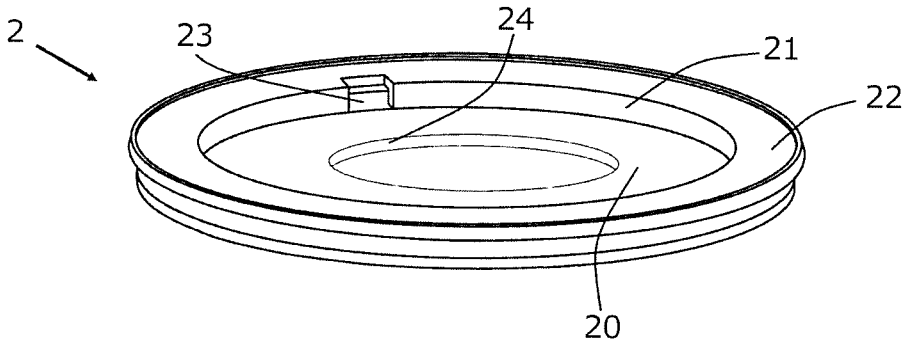
FIG. 3 is a perspective view of the baffle plate of the ear piece of FIG. 1.

FIG. 3 is a perspective view of the baffle plate 2.

The baffle plate 2 has a shape of a circle in plan view (in the forward-rear direction of the baffle plate 2, in the direction from the lower side to the upper side of FIG. 3). The baffle plate 2 includes a bottom portion 20, a side portion 21, and a flange portion 22. The bottom portion 20 has a shape of a disk. The bottom portion 20 is connected to the flange portion 22 by the side portion 21. The bottom portion 20 has an opening 24. The opening 24 is disposed in the central area of the bottom portion 20 in plan view. The side portion 21 has a vent hole 23 for adjusting the sound quality.

As shown in FIG. 2, the driver unit 7 is fixed to the opening 24. A groove having a U-shaped cross-section is formed on the periphery of the baffle plate 2, and the groove is surrounded by the bottom portion 20, the side portion 21, and the flange portion 22. The groove of the baffle plate 2 is covered by a part of the covering member of the ear pad 1 and the ear pad 1 is fixed to the baffle plate 2.

Figure 4:
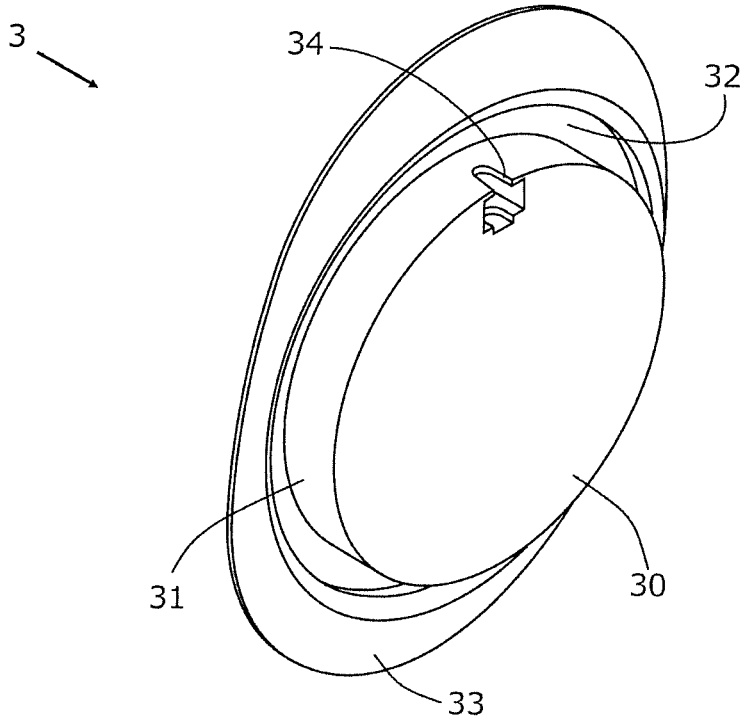
FIG. 4 is a perspective view of a first housing of the ear piece of FIG. 1.

FIG. 4 is a perspective view of the first housing 3.

The first housing 3 has a shape of a circle in plan view. As shown in FIG. 2, the cross-section of the first housing 3 has a shape of a hat in front view. The first housing 3 includes a bottom portion 30, a side portion 31, a receiving portion 32, a flange portion 33, and a microphone receiving hole 34. The microphone receiving hole 34 is disposed on a part of the bottom portion 30 and a part of the side portion 31. The microphone receiving hole 34 will be described below.

As shown in FIG. 2, the first housing 3, the baffle plate 2, and the driver unit 7 form an air chamber S1 behind the driver unit 7. The air chamber S1 is in communication with the exterior of the baffle plate 2 and the first housing 3 through the vent hole 23 of the baffle plate 2. In other words, the air chamber S1 is in communication with the exterior of the housing unit through the vent hole 23. The air pressure in the air chamber S1 is adjusted by the dimension of the vent hole 23, for example. In other words, the driver unit 7 outputs musical sounds (hereinafter referred to as "reproduced sounds") derived from audio signals output from the sound source. The sound quality of reproduced sounds are adjusted by the dimension of the vent hole 23, for example.

Figure 5:
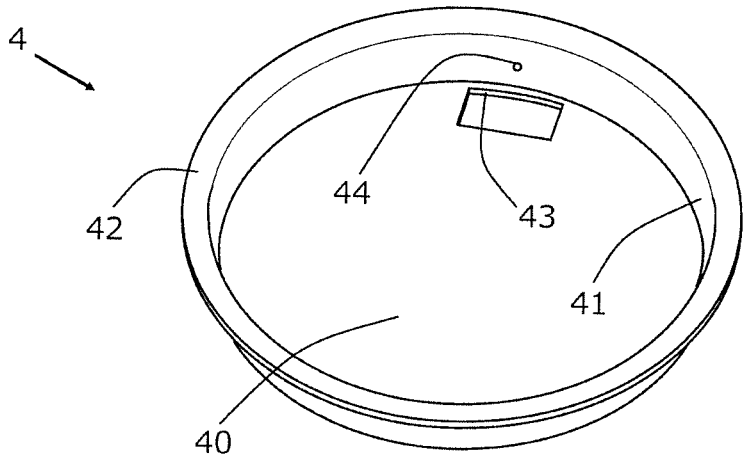
FIG. 5 is a perspective view of a housing cover for the ear piece of FIG. 1.

FIG. 5 is a perspective view of the housing cover 4.

The housing cover 4 has a shape of a circle in plan view. As shown in FIG. 2, the cross-section of the housing cover 4 has a shape of a hat in front view. The housing cover 4 includes a bottom portion 40, a side portion 41, a flange portion 42, a microphone insertion hole 43, and a sound collecting hole 44. The bottom portion 40 is disposed at the rear end of the side portion 41. The flange portion 42 is disposed at the forward end of the side portion 41. The microphone insertion hole 43 is disposed in the bottom portion 40, that is, in the rear portion of the housing cover 4. The sound collecting hole 44 is disposed in the upper portion of the side portion 41.

Referring now back to FIG. 2, the sound collecting hole 44 is disposed in the upper portion of the side portion 41, that is, in the peripheral surface of an upper portion of the housing unit. In other words, the sound collecting hole 44 is disposed in the peripheral surface of the side portion 41, which is in the side proximate to the top of the head of the user in the worn state of the headphone (the upper side in FIG. 2). The sound collecting hole 44 is open toward the upper side of the housing unit, that is, toward the direction of the side proximate to the top of the head of the user in the worn state of the headphone. Thus, the headphone according to the present invention can prevent the wind blowing on the housing unit from directly entering the sound collecting hole 44. As a result, the headphone according to the present invention can prevent generation of noises caused by the pressure of the wind blowing on the housing unit. In addition, when the wind passes through (across) the sound collecting hole 44, the direction of the wind does not correspond to the vibration direction of the diaphragm of the microphone 8, which is described below. Thus, noises caused by wind pressure are reduced.

The wind passing in the penetrating direction (the direction toward the opening) of the sound collecting hole 44 (the vertical direction in FIG. 2) may enter the sound collecting hole 44. However, the sound collecting hole 44 is disposed below the connection member 6 at a certain distance. As a result, the wind passing in the penetrating direction of the sound collecting hole 44 collides with the connection member 6. The wind passing in the penetrating direction of the sound collecting hole 44 therefore does not directly enter the sound collecting hole 44. In other words, the connection member 6 prevents the collision of the sound collecting hole 44 with the wind.

When the flange portion 42 of the housing cover 4 is in contact with the receiving portion 32 of the first housing 3, then the housing cover 4 is positioned behind the first housing 3. The microphone receiving hole 34 of the first housing 3 and the housing cover 4 surrounding the microphone receiving hole 34 constitute an accommodating portion accommodating the microphone 8. That is, the accommodating portion is formed by the first housing 3 and the housing cover 4. The accommodating portion is disposed behind the first housing 3 and in the upper portion of the housing unit. That is, the accommodating portion is disposed in the side proximate to the top of the head of the user in the worn state of the headphone.

The microphone insertion hole 43 of the housing cover 4 is in communication with the microphone receiving hole 34 of the first housing 3. The sound collecting hole 44 of the housing cover 4 is in communication with the microphone receiving hole 34 of the first housing 3. That is, the accommodating portion is in communication with both the microphone insertion hole 43 and the sound collecting hole 44 of the housing cover 4 before the accommodating portion accommodates the microphone 8.

The microphone 8 collects external sounds (hereinafter referred to as "noises") around the headphone (at the exterior of the housing unit). For example, the microphone 8 is an omnidirectional microphone. For example, the microphone 8 is accommodated in the microphone receiving hole 34 through the microphone insertion hole 43 as an insertion opening, with the sound collecting face of the microphone 8 facing the sound collecting hole 44. In other words, the microphone 8 is disposed in the microphone receiving hole 34 (accommodating portion) such that the sound collecting face is directed upward in the worn state of the headphone. Such positioning of the microphone 8 and the sound collecting hole 44 reduces the generation of noises caused by the pressure of the wind on the housing unit. The term "noise" refers to a sound collected by the microphone 8 other than reproduced sounds.

The penetrating direction of the sound collecting hole 44 (the vertical direction in FIG. 2) corresponds to the vibration direction of the diaphragm of the microphone 8. Thus, the noise reaching the headphone is directly collected by the microphone 8 through the sound collecting hole 44, without being changed in direction. As a result, the headphone according to the present invention can predict more accurately the variation of the noise and exhibits higher noise-cancelling effect than the conventional headphone in which the noise reaching the headphone is changed in direction and collected by the microphone.

The sound collecting hole 44 is disposed below the connection member 6 (depicted in FIG. 1) in the worn state of the headphone. The connection member 6 does not cover the sound collecting hole 44 in the worn state of the headphone. That is, the sound collecting hole 44 is open to the exterior of the housing unit. In other words, in the worn state of the headphone, the microphone 8 is always exposed to the exterior of the housing unit (i.e. the air layer exterior to the housing unit is in contact with the microphone 8 through the sound collecting hole 44), and can collect noises. As a result, the headphone always exhibits the noise-cancelling effect.

The second housing 5 has a shape of a circle in plan view. The cross-section of the second housing 5 has a shape of a cup. The second housing 5 includes a bottom portion 50 and a side portion 51. The second housing 5 is disposed behind the housing cover 4. The second housing 5 and the housing cover 4 form an air chamber S2. The microphone insertion hole 43 is closed from the exterior of the housing unit by the second housing 5. That is, the rear portion of the accommodating portion is closed by the second housing 5. Thus, the accommodating portion is in communication with the exterior of the housing unit only through the sound collecting hole 44.

The circuit board 9 has a noise-cancelling circuit (hereinafter referred to as "NC circuit"). The circuit board 9 is fixed, for example, with screws to the forward face of the bottom portion 50 of the second housing 5. Thus, the circuit board 9 is disposed in the air chamber S2, that is, between the first housing 3 and the second housing 5. The NC circuit generates cancelling signals corresponding to the noises collected by the microphone 8.

The circuit board 9 should be disposed in the air chamber S2. That is, the circuit board 9 may be fixed to the rear face of the housing cover 4, for example.

The first housing 3 is acoustically separated from the second housing 5 by the housing cover 4. That is, the air chamber S1 as an acoustic portion defined by the first housing 3 is acoustically separated from the air chamber S2 as a circuit portion defined by the second housing 5. Thus, the microphone 8, which is disposed in the accommodating portion in communication with the air chamber S2, does not collect sounds output to the air chamber S1 from the driver unit 7 and the NC circuit does not generate cancelling signals. In other words, the sound quality of the reproduced sounds output from the driver unit 7 are not degraded by the sounds output to the air chamber S1 from the driver unit 7.

The dimensions and shape of the accommodating portion are substantially the same as those of the microphone 8, for example. The gap between the microphone 8 and the accommodating portion having the microphone 8 accommodated in is filled with adhesive, for example, to fix the microphone 8 in the accommodating portion. The microphone insertion hole 43 is closed after the microphone 8 is accommodated in the accommodating portion, with the output cable of the microphone 8 extracted into the air chamber S2. In other words, the accommodating portion is separated from the air chamber S2. As a result, the accommodating portion is in communication with the exterior of the housing unit only through the sound collecting hole 44. In other words, the microphone 8 only collects sound waves passing through the sound collecting hole 44 and entering the accommodating portion.

Figure 6:
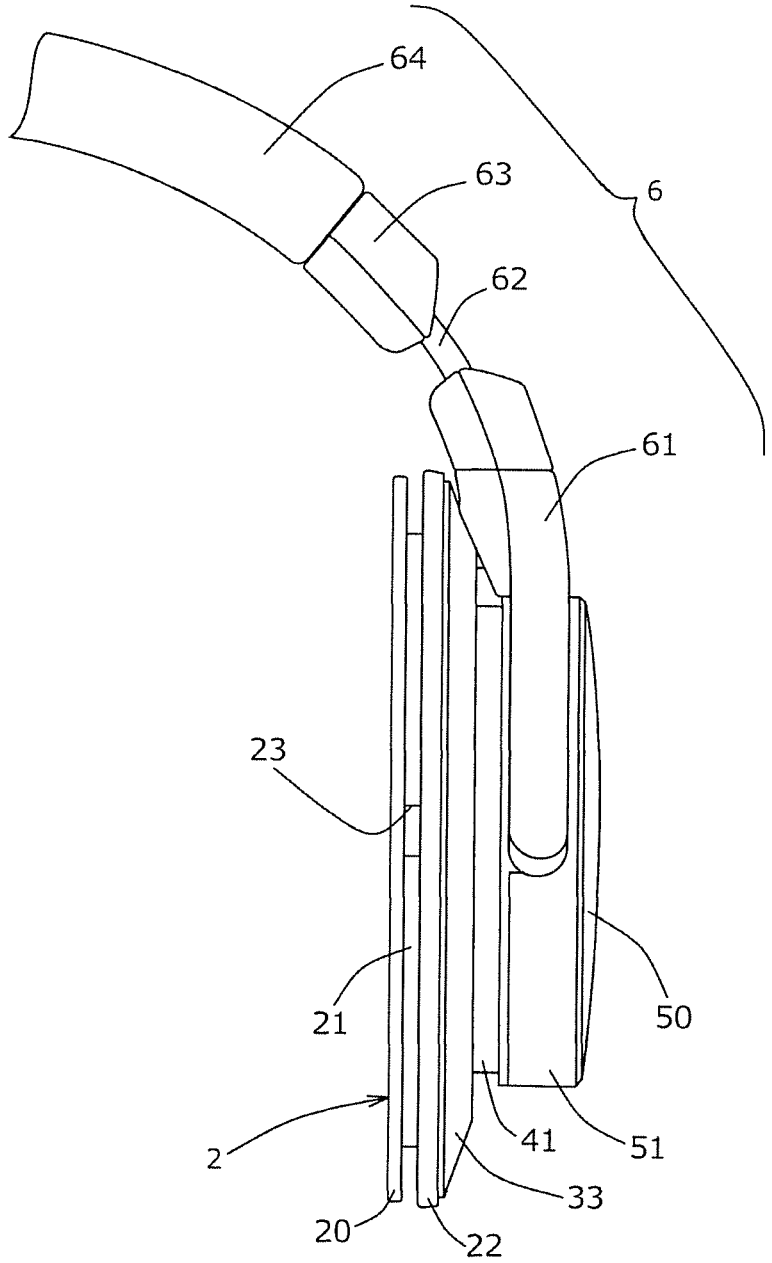
FIG. 6 is a front view of the ear piece of FIG. 1 from which an ear pad is removed.

FIG. 6 is a front view of the ear piece 100 from which the ear pad 1 is removed.

The vent hole 23 disposed in the side portion 21 of the baffle plate 2 is positioned in the front side of the ear piece 100 (the front side in FIG. 6).

Figure 7:
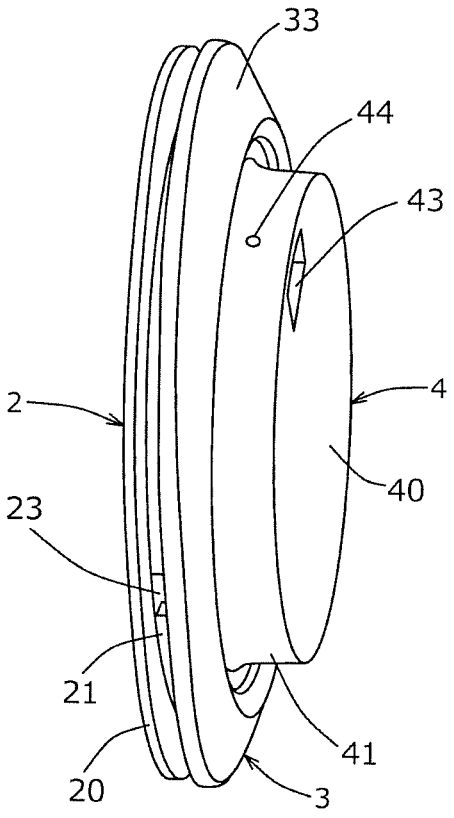
FIG. 7 is a perspective view of a housing unit of the ear piece of FIG. 6.

FIG. 7 is a perspective view of the ear piece 100 from which the ear pad 1 and the second housing 5 are removed. In other words, FIG. 7 is a perspective view of integrated baffle plate 2, the first housing 3, and the housing cover 4.

As described above, the sound collecting hole 44 of the housing cover 4 is disposed in the upper peripheral surface of the housing unit. The vent hole 23 of the baffle plate 2 is disposed in the front (the side proximate to the face of the user in the worn state of the headphone) portion of the housing unit.

As shown in FIG. 7, the sound collecting hole 44 is at least 90 degrees separated from the vent hole 23 in the circumferential direction of the housing unit. Such positioning in which the sound collecting hole 44 is separated from the vent hole 23 prevents the musical sounds leaking from the driver unit 7 through the vent hole 23 (hereinafter referred to as "emitted sound") from being collected by the microphone 8 through the sound collecting hole 44.

The positions of the sound collecting hole and the vent hole on the housing unit should be the positions preventing the emitted sounds from being collected by the microphone 8 through the sound collecting hole. That is, for example, the vent hole may be disposed in the side proximate to the back of the head of the user in the worn state of the headphone. In other words, the vent hole may be disposed in the back side of the housing unit.

Figure 8:
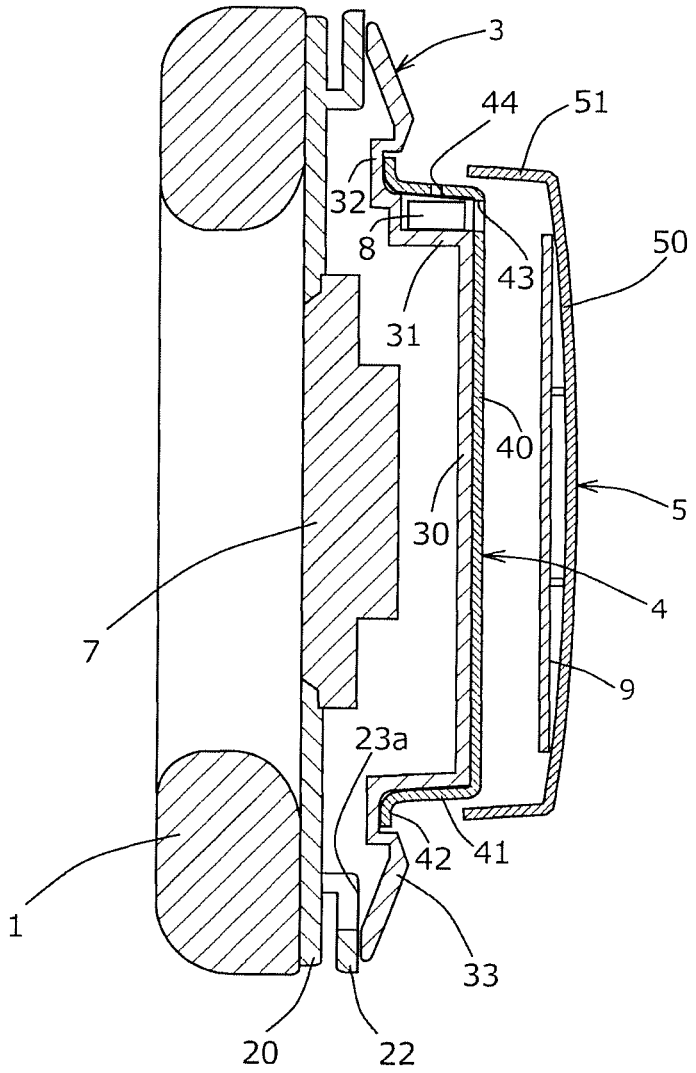
FIG. 8 is a cross-sectional front view of an ear piece of the noise cancelling headphone according to another embodiment of the present invention.

FIG. 8 is a cross-sectional front view of an ear piece of a headphone according to another embodiment of the present invention where like reference numbers reference similar parts.

As another example of the positions of the sound collecting hole and the vent hole on the housing unit, the sound collecting hole and the vent hole may be disposed at opposite positions in the circumferential direction of the housing unit. That is, for example, the sound collecting hole 44 may be disposed in the upper side (the side proximate to the top of the head of the user in the worn state of the headphone) portion of the housing unit, and the vent hole 23*a* may be disposed in the lower (the side proximate to the foot of the user in the worn state of the headphone) portion of the housing unit.

Figure 9:
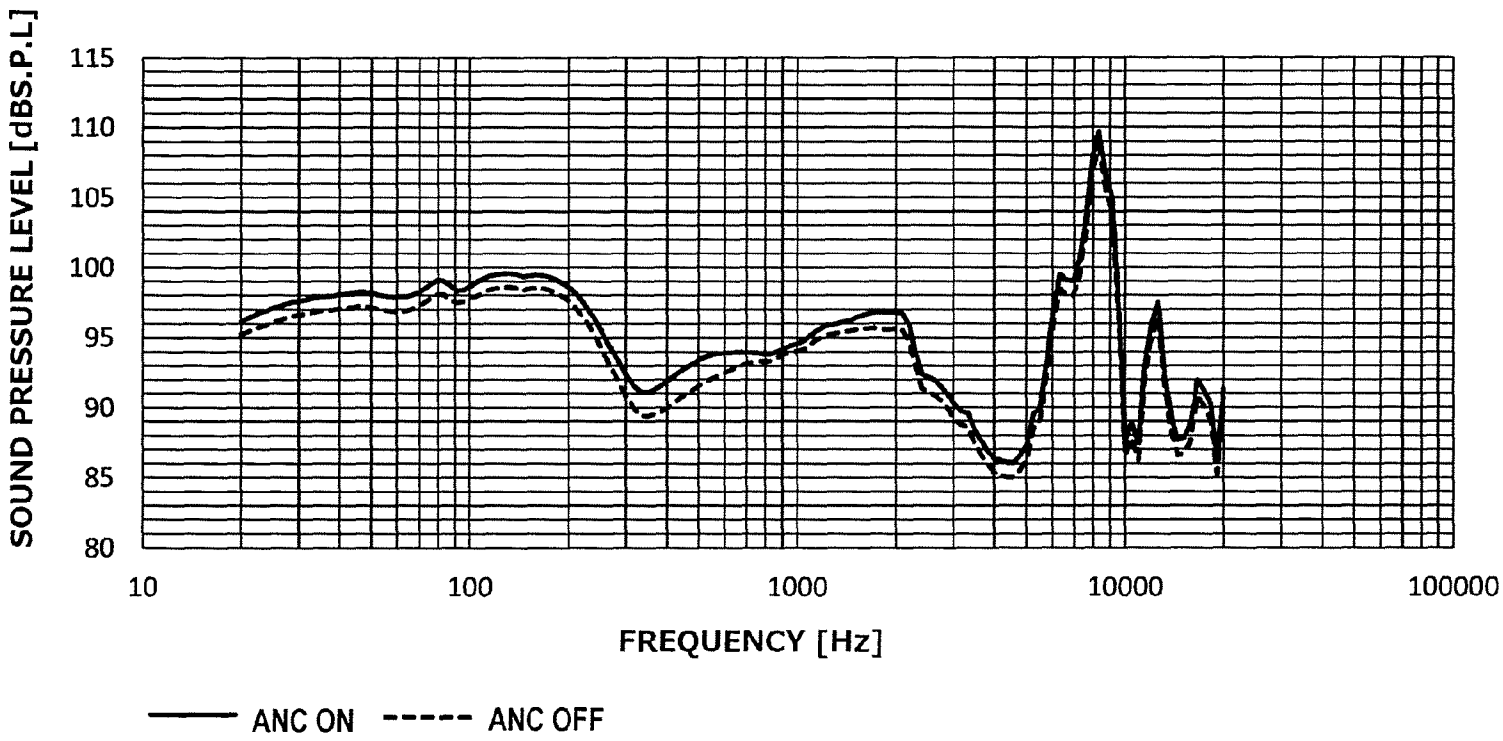
FIG. 9 is a graph showing the frequency characteristics of the noise cancelling headphone according to the present invention.

FIG. 9 is a graph showing the frequency characteristics of the headphone according to the present invention.

In FIG. 9, the solid line represents the frequency characteristic of the headphone in the activated state of the noise-cancelling function, in other words, in the state where the NC circuit can generate cancelling signals corresponding to the noises collected by the microphone 8. The dotted line represents the frequency characteristic of the headphone in the deactivated state of the noise-cancelling function, in other words, in the state where the NC circuit cannot generate cancelling signals corresponding to the noises collected by the microphone 8. As shown in FIG. 9, a difference in the frequency characteristics of the headphone of the present invention between the activated state and the deactivated state of the noise-cancelling function is small. That is, FIG. 9 indicates that the collecting of the emitted sound by the microphone 8 is prevented in the headphone according to the present invention.

The microphone receiving hole 34, which is an accommodating portion accommodating microphone 8, is disposed in the upper portion of the housing unit in the worn state of the headphone. For example, as shown in FIG. 2, the microphone receiving hole 34 is disposed above the driver unit 7. The accommodating portion is disposed in the upper portion of the housing unit. In other words, since the sound collecting hole 44 is disposed in the upper portion of the housing unit, the microphone 8 can collect noises from any direction in the surrounding space of the housing unit without delay (i.e., the collected sound is essentially an average of all sound from any direction). As a result, the headphone according to the present invention can reduce a feeling of strangeness or discomfort to the user caused by the directionality of the noise-cancelling effect.

Figure 10:
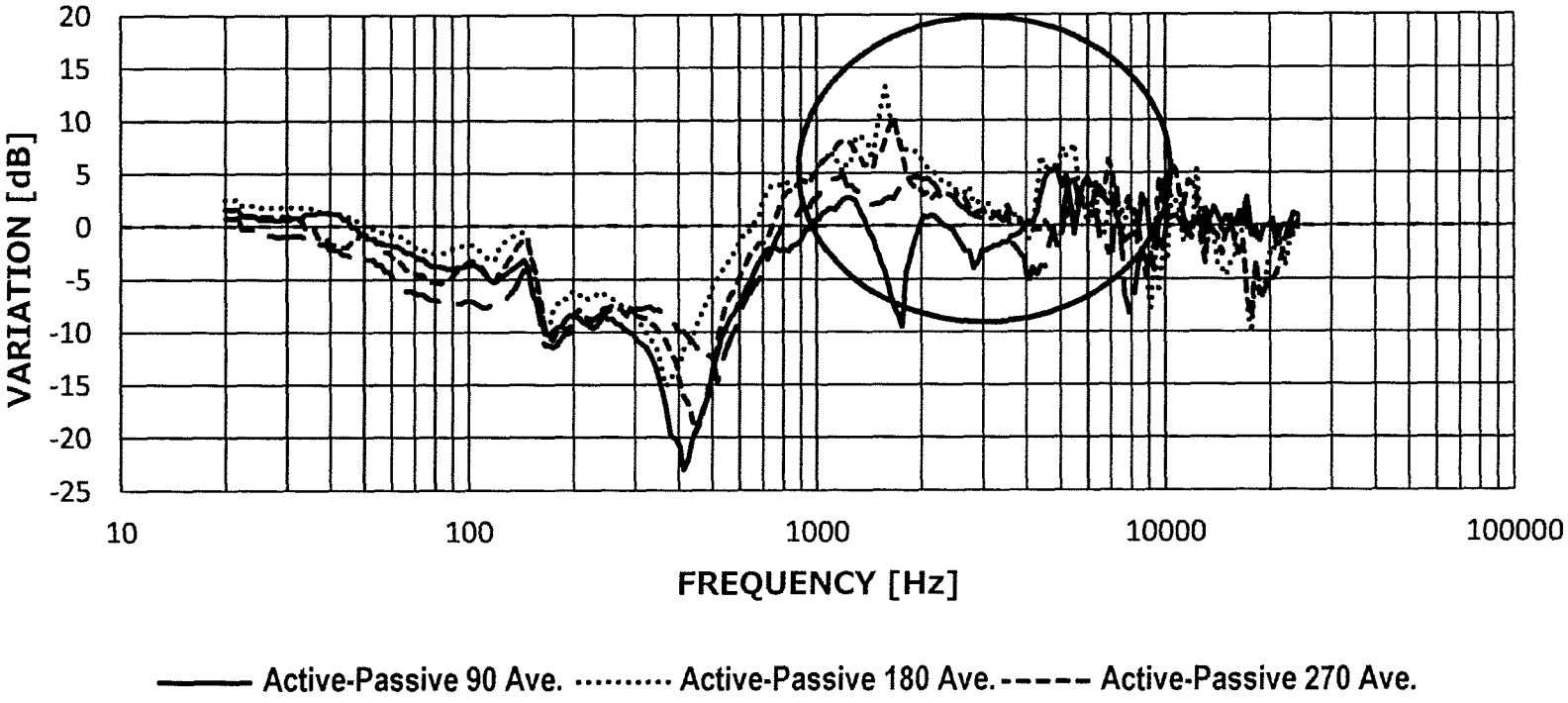
FIG. 10 is a graph showing comparison of the noise-cancelling effects of the noise-cancelling headphone according to the present invention.
Figure 11:
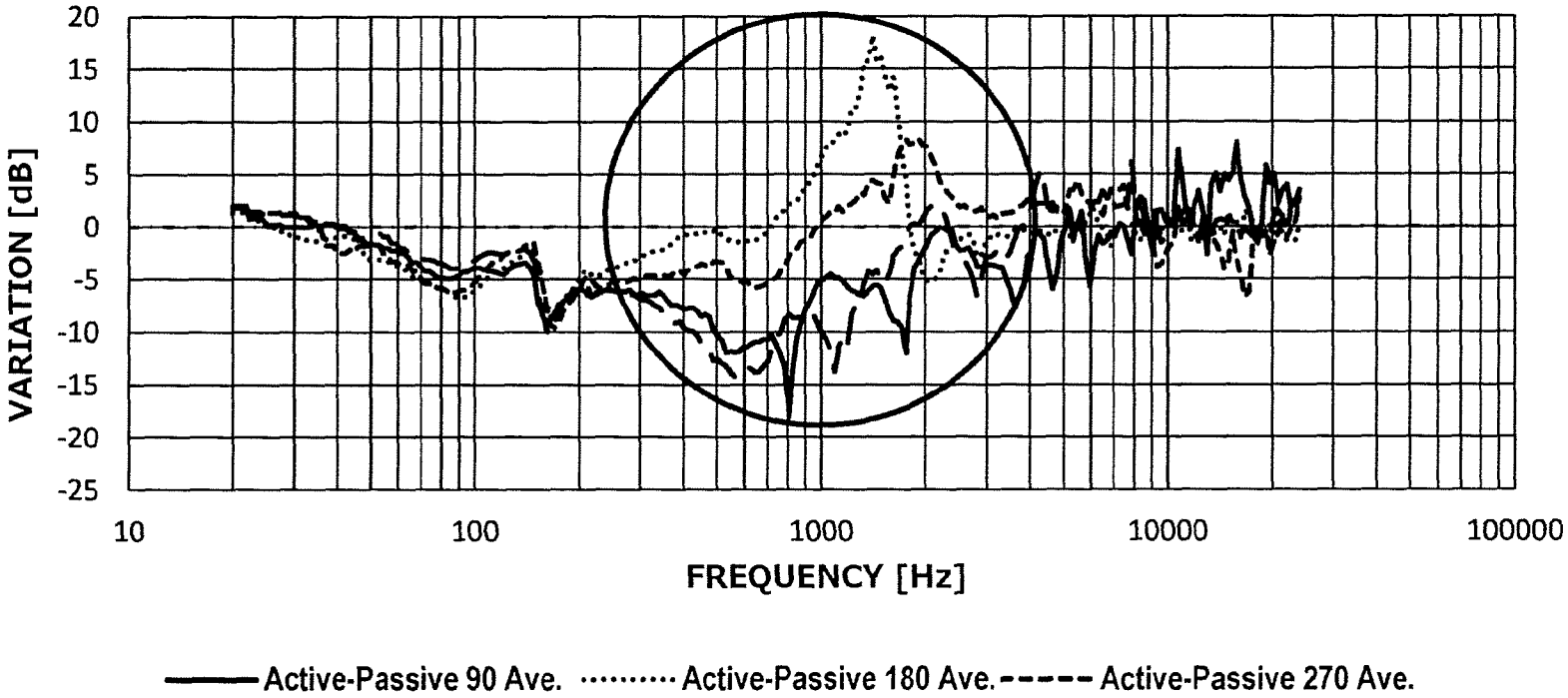
FIG. 11 is another graph showing comparison of the noise-cancelling effects of the noise-cancelling headphone according to the present invention.
Figure 12:
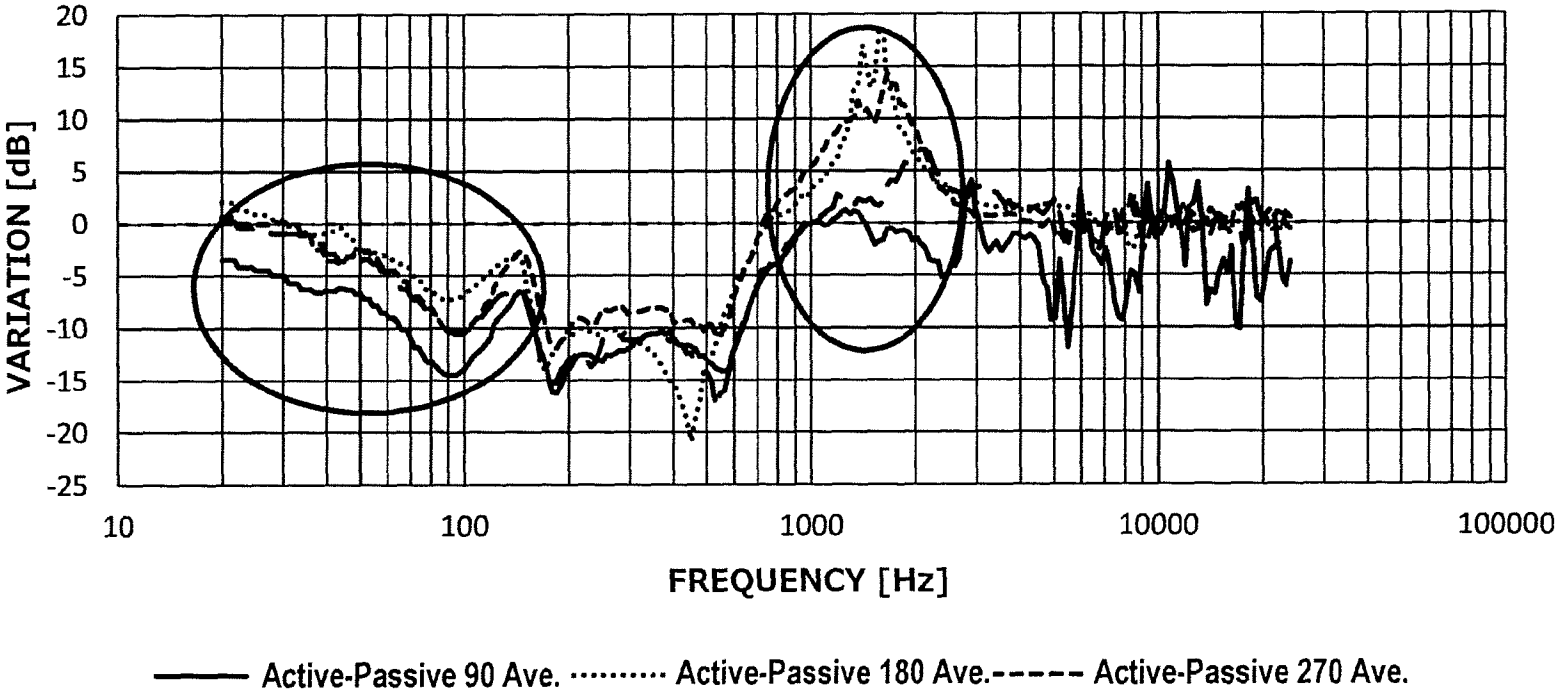
FIG. 12 is another graph showing comparison of the noise-cancelling effects of the noise-cancelling headphone according to the present invention.

FIGS. 10, 11, and 12 are graphs showing comparison of the noise-cancelling effects of the headphone responding to noises generated in different directions relative to the headphone. FIG. 10 shows the noise-cancelling effects of the headphone having a sound collecting hole disposed in the upper (the upper side of FIG. 1) portion of the headphone. FIG. 11 shows the noise-cancelling effects of the headphone having a sound collecting hole disposed in the front (the front side of FIG. 1) portion of the headphone. FIG. 12 shows the noise-cancelling effects of the headphone having a sound collecting hole disposed in the rear (the right side in FIG. 1) portion of the headphone. Each graph shows the noise-cancelling effects responding to the noises generated in the directions having angles 90, 180, 270, and 360 degrees.

FIG. 11 indicates that the noise-cancelling effect varies largely among the different directions within the frequency range from about 300 Hz to 2 kHz. FIG. 11 indicates that the headphone has different noise cancelling effects depending on the directions of generated noises. As described above, the headphone having a sound collecting hole disposed in the front portion of the headphone has both directions having high noise cancelling effects and directions having low noise-cancelling effects. Thus, the headphone may cause a feeling of strangeness to the user.

FIG. 12 indicates that the noise-cancelling effect varies less than in FIG. 11 among the different directions. FIG. 12 indicates the headphone has a large difference in the noise-cancelling effect around a frequency of 1 kHz. FIG. 12 also indicates the noise-cancelling effects are high when the direction of generated noises is 90 degrees. As described above, the headphone having a sound collecting hole disposed in the rear portion of the headphone has higher noise-cancelling effect in one direction (of 90 degrees) than the other directions. Thus, the headphone having a sound collecting hole disposed in the rear portion of the headphone can cause a feeling of strangeness to the user.

On the other hand, in FIG. 10, the difference in noise-cancelling effect among the different directions is smaller than in FIGS. 11 and 12. Accordingly, for example, even when the direction of generated noises relative to the headphone is varied by movement of the user wearing the headphone, the difference in noise-cancelling effect among the different directions is small. As described above, the headphone having a sound collecting hole disposed in the upper portion of the headphone reduces a feeling of strangeness to the user due to the difference in directions of generated noises.

According to the embodiments described above, the sound collecting hole 44 is open toward the upper portion of the housing unit, that is, toward the top of the head of the user in the worn state of the headphone. The penetrating direction of the sound collecting hole 44 corresponds to the vibration direction of the diaphragm of the microphone 8. Thus, the noise reaching the housing unit is collected by the microphone 8, without being changed in direction. Accordingly, the headphone according to the present invention can predict more accurately the variation in the noise and can exhibit higher noise-cancelling effect than the conventional headphone which the noise reaching the headphone changes the direction and is then collected by the microphone, with avoiding the influence of the wind.

In addition, according to the embodiments described above, the air chamber S1 as the acoustic portion defined by the first housing 3, is acoustically separated from the air chamber S2 as the circuit portion defined by the second housing 5. As a result, the microphone 8, which is disposed in the air chamber S2, does not collect sounds output from the driver unit 7 and emitted into the air chamber S1. Thus, the NC circuit does not generate cancelling signals corresponding to the emitted sounds. Accordingly, the headphone according to the present invention avoids the influence of the wind and can prevent the degradation in the sound quality of the reproduced sound output from the driver unit 7.

The embodiments described above are the embodiments which the structure of the right ear piece is the same as the structure of the left ear piece. In other words, each of the right ear piece and the left ear piece includes a microphone.

Alternatively, according to another embodiment of the present invention, only the right ear piece includes a microphone, or only the left ear piece includes a microphone.

The invention claimed is:

1. A noise-cancelling headphone comprising:
an ear piece; and
a connection member configured for fixing the ear piece to a head of a user, wherein the ear piece comprises:
a housing unit having an interior and an exterior;
a driver unit attached to the housing unit; and
a microphone collecting external sounds at the exterior of the housing unit,
wherein the housing unit comprises:
an accommodating portion accommodating the microphone; and
a sound collecting hole establishing communication between the accommodating portion and the exterior of the housing unit,
wherein the accommodating portion is disposed in an upper portion of the housing unit of the noise-cancelling headphone when worn by a user, and
wherein the sound collecting hole is open toward an upper side of the housing unit of the noise-cancelling headphone when worn by the user, and is disposed below an underside of the connection member of the noise-cancelling headphone when worn by the user.

2. The noise-cancelling headphone according to claim 1, wherein the penetrating direction of the sound collecting hole corresponds to a vibration direction of a diaphragm of the microphone.

3. The noise-cancelling headphone according to claim 1, wherein the connection member prevents the sound collecting hole from directly colliding with wind.

4. The noise-cancelling headphone according to claim 1, wherein the accommodating portion is disposed above the driver unit.

5. The noise-cancelling headphone according to claim 1, wherein the sound collecting hole is open to the exterior of the housing unit.

6. The noise-cancelling headphone according to claim 1, wherein
the housing unit comprises:
a baffle plate to which the driver unit is attached;
a first housing disposed behind the baffle plate;
a second housing disposed behind the first housing; and
a housing cover disposed between the first housing and the second housing, wherein
the accommodating portion is formed by the first housing and the housing cover, and
the sound collecting hole is disposed in the housing cover.

7. The noise-cancelling headphone according to claim 6, wherein a rear portion of the accommodating portion is closed by the second housing.

8. The noise-cancelling headphone according to claim 6, wherein
the housing unit has a vent hole establishing communication between an air chamber defined by the first housing and the exterior of the housing unit, and
the vent hole is disposed in the baffle plate.

9. The noise-cancelling headphone according to claim 6, further comprising a circuit board generating cancelling signals from external sounds collected by the microphone, the circuit board is disposed between the first housing and the second housing.

10. The noise-cancelling headphone according to claim 6, wherein the first housing is acoustically separated from the second housing.

11. The noise-cancelling headphone according to claim 6, wherein the accommodating portion is disposed in a rear of the first housing.

12. The noise-cancelling headphone according to claim 6, wherein
the housing cover and the second housing define an air chamber, and
the accommodating portion is separated from the air chamber.

13. A noise-cancelling headphone comprising:
a first ear piece;
a second ear piece; and
a connection member connecting the first ear piece and the second ear piece, wherein
the first ear piece comprises:
a first housing unit having a first interior and a first exterior;
a first driver unit attached to the first housing unit; and
a first microphone collecting external sounds at the first exterior of the first housing unit,
wherein the first housing unit comprises:
an accommodating portion accommodating the first microphone; and
a sound collecting hole establishing communication between the accommodating portion and the exterior of the first housing unit,
wherein the accommodating portion is disposed in an upper portion of the first housing unit of the noise-cancelling headphone when worn by a user, and
wherein the sound collecting hole is open toward an upper side of the first housing unit of the noise-cancelling headphone when worn by the user, and is disposed below an underside of the connection member of the noise-cancelling headphone when worn by the user.

14. The noise-cancelling headphone according to claim 13, wherein the second ear piece comprises:
a second housing unit having a second interior and a second exterior;
a second driver unit attached to the second housing unit; and
a second microphone collecting external sounds at the second exterior of the second housing unit.

* * * * *